US008898985B2

(12) United States Patent
Lehane, Jr.

(10) Patent No.: US 8,898,985 B2
(45) Date of Patent: Dec. 2, 2014

(54) CEILING PANEL SYSTEM

(75) Inventor: James J. Lehane, Jr., McHenry, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/309,580

(22) Filed: Dec. 2, 2011

(65) Prior Publication Data

US 2012/0167514 A1 Jul. 5, 2012

Related U.S. Application Data

(60) Provisional application No. 61/428,239, filed on Dec. 30, 2010.

(51) Int. Cl.

| | |
|---|---|
| ***E04B 9/26*** | (2006.01) |
| ***E04B 9/24*** | (2006.01) |
| ***E04B 9/06*** | (2006.01) |
| ***E04B 9/04*** | (2006.01) |
| *F24D 3/16* | (2006.01) |

(52) U.S. Cl.
CPC . *E04B 9/26* (2013.01); *E04B 9/245* (2013.01); *E04B 9/065* (2013.01); *E04B 9/0478* (2013.01)
USPC ..... 52/506.07; 52/506.05; 52/506.08

(58) Field of Classification Search
CPC ..... E04B 9/0478; E04B 9/065; E04B 9/068; E04B 9/122; E04B 9/127; E04B 9/245; E04B 9/26; E04B 2009/062
USPC ..... 52/506.07, 506.08, 506.09, 506.05
See application file for complete search history.

(56) References Cited

U.S. PATENT DOCUMENTS

| | | | | |
|---|---|---|---|---|
| 1,728,231 | A | 9/1929 | Denk | |
| 1,857,490 | A * | 5/1932 | Barrett | 52/435 |
| 2,051,064 | A * | 8/1936 | Worden | 52/416 |
| 2,250,411 | A * | 7/1941 | Baker | 52/506.09 |
| RE22,091 | E * | 5/1942 | Rippen | 52/506.05 |
| 2,710,175 | A * | 6/1955 | Jorn | 165/56 |
| 3,153,304 | A * | 10/1964 | Evangelista | 52/144 |
| 3,440,331 | A | 4/1969 | Cohen | |
| 3,703,307 | A * | 11/1972 | Curtis | 403/173 |
| 3,710,520 | A * | 1/1973 | Federowicz | 52/27 |

(Continued)

FOREIGN PATENT DOCUMENTS

| | | | |
|---|---|---|---|
| EP | 0468755 A1 | 1/1992 | |
| EP | 2053175 A1 * | 4/2009 | E04F 13/08 |

(Continued)

OTHER PUBLICATIONS

International Search Report and Written Opinion dated Mar. 12, 2012 of corresponding International Patent Application No. PCT/US2011/064316, filed Dec. 12, 2011.

*Primary Examiner* — Charles A Fox
*Assistant Examiner* — Joseph J Sadlon
(74) *Attorney, Agent, or Firm* — Pearne & Gordon LLP

(57) ABSTRACT

A ceiling panel system includes a plurality of grid members that are operable to form a grid suspendable from a ceiling, the grid having grid member intersections; and a plurality of ceiling panels, each ceiling panel including a planar surface and a plurality of upturned edges arranged about the periphery of the planar surface. The upturned edges include a catch operable to attach the panels to the face of the grid intermediately to the intersections to form a ceiling surface.

6 Claims, 2 Drawing Sheets

(56) References Cited

U.S. PATENT DOCUMENTS

| | | | | | |
|---|---|---|---|---|---|
| 4,010,591 | A | | 3/1977 | Gross | |
| 4,263,763 | A | * | 4/1981 | Bouwens | 52/404.3 |
| 4,546,587 | A | | 10/1985 | Mosch | |
| D299,871 | S | | 2/1989 | Jennings | |
| 5,056,287 | A | | 10/1991 | Weber | |
| 5,060,360 | A | | 10/1991 | Dornes et al. | |
| 5,191,743 | A | * | 3/1993 | Gailey | 52/718.05 |
| 5,414,969 | A | * | 5/1995 | Krejci et al. | 52/311.3 |
| 5,609,007 | A | * | 3/1997 | Eichner | 52/747.1 |
| 5,699,641 | A | * | 12/1997 | Tinen et al. | 52/506.07 |
| 6,536,173 | B2 | * | 3/2003 | Rebman | 52/465 |
| 6,834,467 | B2 | * | 12/2004 | Gulbrandsen et al. | 52/506.07 |
| 6,945,414 | B1 | | 9/2005 | Stevens et al. | |
| RE39,091 | E | * | 5/2006 | Kuelker | 52/506.05 |
| 7,096,632 | B2 | * | 8/2006 | Pacione | 52/506.05 |
| 7,383,663 | B2 | * | 6/2008 | Pacione | 52/120 |
| 2003/0205016 | A1 | | 11/2003 | Gulbrandsen et al. | |
| 2006/0005495 | A1 | * | 1/2006 | Stessel et al. | 52/506.07 |
| 2008/0086962 | A1 | | 4/2008 | Jahn et al. | |
| 2008/0276560 | A1 | | 11/2008 | Labonte | |

FOREIGN PATENT DOCUMENTS

| | | | | | |
|---|---|---|---|---|---|
| FR | 1201640 | A | * | 1/1960 | E04B 9/04 |
| FR | 2590304 | A1 | * | 5/1987 | E04B 9/26 |
| GB | 2204073 | A | * | 11/1988 | E04B 5/60 |
| WO | WO 2009130720 | A1 | * | 10/2009 | E04B 1/82 |

* cited by examiner

FIG. 2B
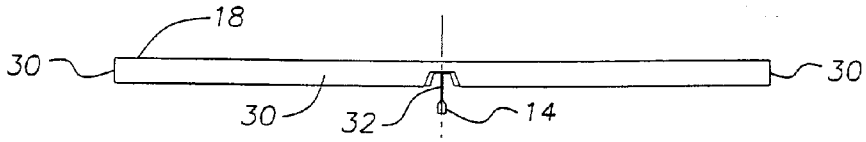
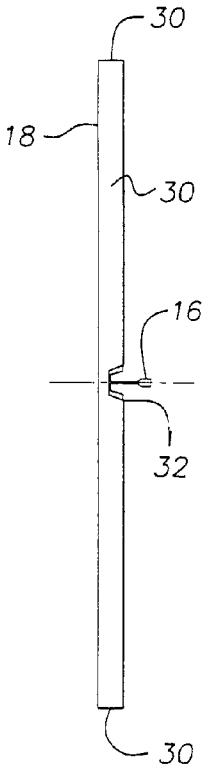
FIG. 2A
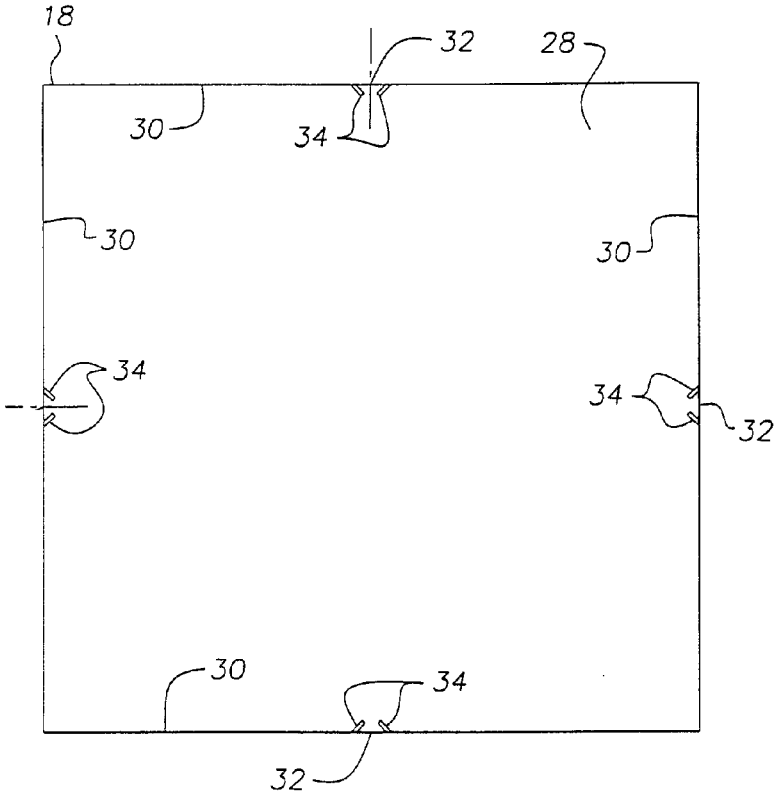
FIG. 2

CEILING PANEL SYSTEM

This application claims the priority of U.S. Provisional Application No. 61/428,239, filed Dec. 30, 2010.

BACKGROUND OF THE INVENTION

The present invention relates to suspended ceiling systems and more particularly to a grid and panel system.

Suspended ceiling systems are often constructed using a suspended grid formed from intersecting grid members. The grid members commonly have an inverted T-shaped cross section that permits ceiling panels to be dropped in between the vertical portions of the grid members and to be supported by the horizontal portions of the inverted T-shape.

In such an arrangement, the grid members define the junctions between the ceiling panels. Apertures for sprinkler heads, light fixtures such as can lights or other similar structures needing an aperture in the ceiling surface are then located away from the edges of the ceiling panels to avoid interference with the grid members.

SUMMARY OF THE INVENTION

A ceiling panel system includes a plurality of grid members that are operable to form a grid suspendable from a ceiling, the grid having grid member intersections; and a plurality of ceiling panels, each ceiling panel including a planar surface and a plurality of upturned edges arranged about the periphery of the planar surface. The upturned edges include a catch operable to attach the panels to the face of the grid intermediately to the intersections to form a ceiling surface.

BRIEF DESCRIPTION OF THE DRAWINGS

FIG. 2 is a top plan view of a ceiling panel;

FIG. 2A is a side elevational view of a ceiling panel;

FIG. 2B is another side view of a ceiling panel, and

DESCRIPTION OF THE PREFERRED EMBODIMENTS

Figure 1:
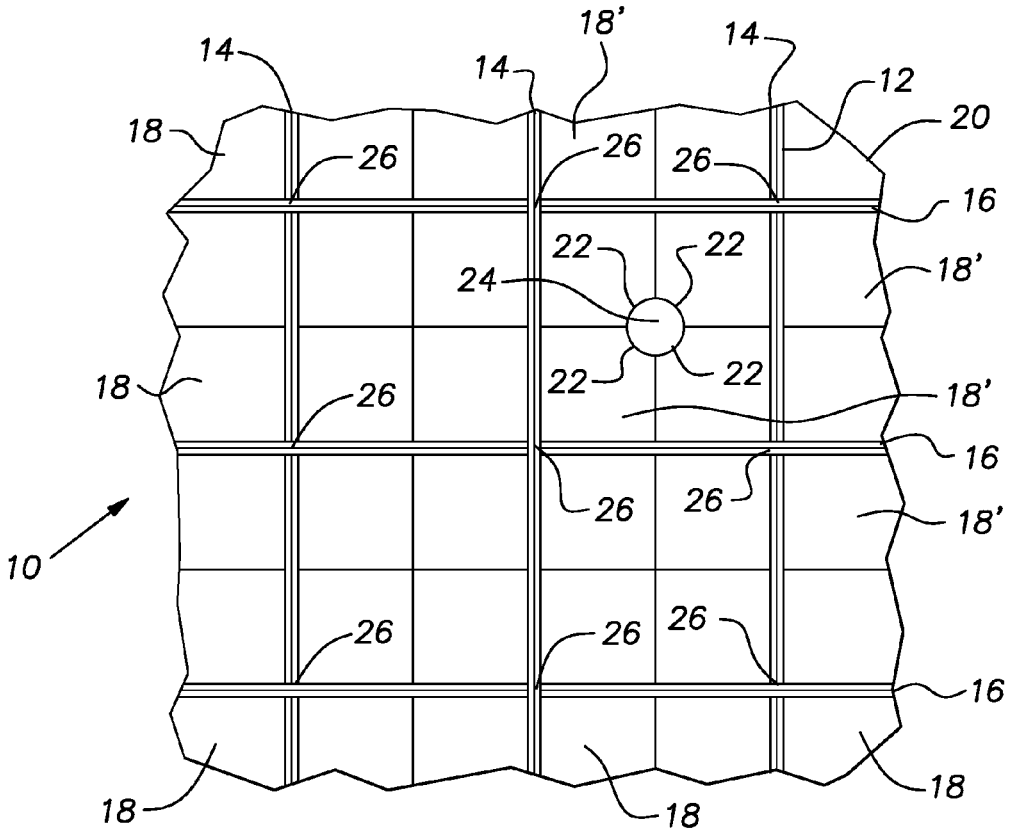
FIG. 1 is a top plan view of a ceiling system according to some aspects of the invention.

Referring to FIG. 1, a ceiling panel system 10 includes a grid 12 formed of main grid members 14 and cross grid members 16. Ceiling panels 18, 18' are attached to the face of the grid 12 to form a ceiling surface 20. The ceiling panels 18' are additionally provided with cutouts 22 that as a group provide a circular aperture 24 in the ceiling surface 20. From below the ceiling surface 20, the grid 12 is hidden by the ceiling panels 18, 18'. The aperture 24 at the junction of the ceiling panels 18' is located intermediate to the intersections 26 of the grid 12.

While the exemplary aperture 24 shown is circular, other shape apertures are possible and contemplated herein.

Referring to FIG. 2, a ceiling panel 18 includes a planar surface 28 with upturned edges 30. The panel 18 may be, for example, metal or plastic sheet of sufficient rigidity and strength to maintain its geometry. The edges 30 are each provided with at least one catch 32 formed from resilient wings 34 that, for example, snap over the bottom of the inverted T-shaped cross section grid members 14, 16 at a location intermediate to the intersections 26 (see FIG. 1).

The catches 32 may be, for example, stamped and formed into the edges 30. The edges 30 are shown substantially coextensive with the periphery of the planar surface 28, but the edges 30 may be, for example, coextensive with only a portion of the periphery of the planar surface as long as the panel 30 exhibits sufficient strength and rigidity.

Figure 3:
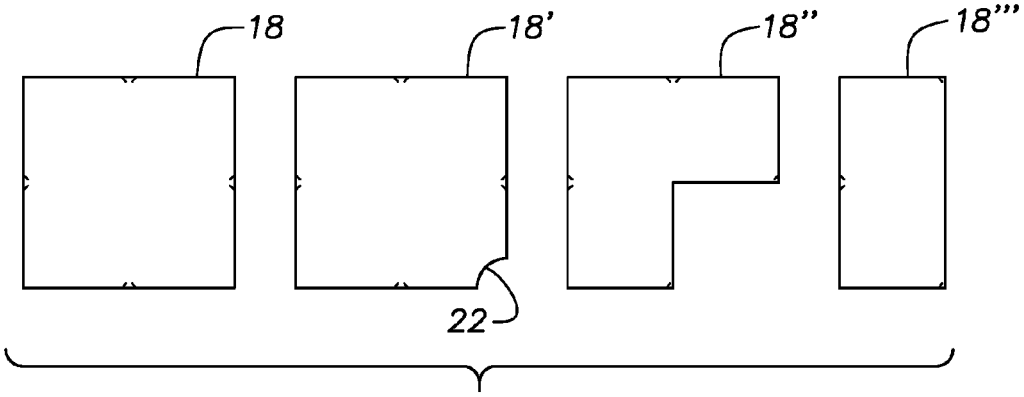
FIG. 3 is a top plan view of examples of ceiling panels according to some aspects of the invention.

Referring to FIG. 3, non-exhaustive examples of ceiling panels include square panel 18, square panel 18' with the quarter circle cutout 22, square panel 18" with a square cutout and rectangular panel 18'''. Square panels, for example, can measure 2 foot by 2 foot or metric equivalent and the various other panels can have corresponding dimension.

Besides permitting the grid to be hidden, the present invention permits apertures for sprinkler heads, light fixtures such as can lights or other similar structures needing an aperture in the ceiling surface to be located at the junctions of the ceiling panels without interfering with the grid members or requiring special accommodating grid pieces.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A ceiling panel system, said system comprising:

a plurality of inverted T-shaped cross-section grid members each with a bottom horizontal portion, said grid members forming a grid suspended from a ceiling, said grid having grid member intersections; and a plurality of ceiling panels, each said ceiling panel including a planar surface and a plurality of upturned edges arranged about the periphery of said planar surface, said upturned edges having a horizontal midpoint, a catch disposed locally and exclusively at each upturned edge horizontal midpoint, said catches being formed from resilient wings that snap over the bottom horizontal portion of a respective inverted T-shaped cross-section grid member extending across the middle of the panel perpendicularly to the respective upturned edge at a face of said grid intermediately to said intersections of said grid members to form a ceiling surface.

2. The ceiling panel system according to claim 1, wherein said ceiling panel planar surfaces are rectangular.

3. The ceiling panel system according to claim 2, wherein a group of said ceiling panels include peripheral cutouts that provide a circular aperture in the ceiling surface at a junction of said group.

4. The ceiling panel system according to claim 1, wherein said ceiling panel planar surfaces are square.

5. The ceiling panel system according to claim 1, wherein a group of said ceiling panels include peripheral cutouts that provide an aperture in the ceiling surface.

6. A ceiling panel for use in a suspended ceiling comprising a square sheet bounded by four edges, each edge providing a catch exclusively adjacent a midpoint of a length of the edge, each catch being formed from a pair of resilient wings that snap over the bottom horizontal portion of an inverted T-shaped cross-section grid member to grip an upper side of a lower flange of the bottom portion of the inverted T-shaped grid member of a suspended ceiling grid member extending across the middle of the panel transversely to the respective edge.

* * * * *